US011731308B2

(12) United States Patent
Shimamura et al.

(10) Patent No.: US 11,731,308 B2
(45) Date of Patent: Aug. 22, 2023

(54) ELECTRIC STAPLER

(71) Applicant: MAX CO., LTD., Tokyo (JP)

(72) Inventors: Masashi Shimamura, Tokyo (JP); Tatsuya Kenjo, Tokyo (JP)

(73) Assignee: MAX CO., LTD., Tokyo (JP)

( * ) Notice: Subject to any disclaimer, the term of this patent is extended or adjusted under 35 U.S.C. 154(b) by 229 days.

(21) Appl. No.: 17/098,093

(22) Filed: Nov. 13, 2020

(65) Prior Publication Data

US 2021/0146571 A1 May 20, 2021

(30) Foreign Application Priority Data

Nov. 15, 2019 (JP) ..... 2019-206902

(51) Int. Cl.
*B27F 7/36* (2006.01)
*B27F 7/19* (2006.01)

(52) U.S. Cl.
CPC . *B27F 7/36* (2013.01); *B27F 7/19* (2013.01)

(58) Field of Classification Search
CPC ..... B27F 7/36; B27F 7/19
See application file for complete search history.

(56) References Cited

U.S. PATENT DOCUMENTS 5,595,336 A * 1/1997 Everdyke ..... B25C 5/0228 227/7
2001/0023886 A1 9/2001 Ishizaki
2005/0063747 A1 3/2005 Ushio
2005/0242153 A1* 11/2005 Adams ..... B25C 5/02 227/120
2006/0266786 A1 11/2006 Aoki
2015/0314626 A1 11/2015 Kushida et al.

FOREIGN PATENT DOCUMENTS

| | | | |
|---|---|---|---|
| EP | 1 1136208 | A1 | 9/2001 |
| JP | 2005-096892 | A | 4/2005 |
| JP | 4277417 | B2 | 6/2009 |
| JP | 2012-066315 | A | 4/2012 |
| JP | 2015-209334 | A | 11/2015 |
| JP | 2019-130754 | A | 8/2019 |

OTHER PUBLICATIONS

Extended EP Search Report for European Application No. 20207595.8 dated Apr. 30, 2021.
Japanese Office Action for JP Application No. 2019-206902 dated May 30, 2023 with English Translation (pp. 1-9).

* cited by examiner

*Primary Examiner* — Praachi M Pathak
(74) *Attorney, Agent, or Firm* — Weihrouch IP

(57) ABSTRACT

An electric stapler includes: a binding part configured to bind a sheet bundle by striking out a staple having a crown portion and leg portions; and a first guide part configured to guide the sheet bundle to the binding part, and a second guide part facing the first guide part. The first guide part and the second guide part face each other at a distance. The first guide part and the second guide part are opened therebetween as both sides along a length direction of the crown portion, and one side away from the binding part are coupled each other. Lengths from end portions on one side, which are away from the binding part along the direction orthogonal to the length direction of the crown portion, of the first guide part and the second guide part to the binding part are 15 mm or longer.

7 Claims, 15 Drawing Sheets

ELECTRIC STAPLER

CROSS-REFERENCE TO RELATED APPLICATIONS

This application is based upon and claims the benefit of priority from prior Japanese patent application No. 2019-206902, filed on Nov. 15, 2019, the entire contents of which are incorporated herein by reference.

TECHNICAL FIELD

The present invention relates to an electric stapler configured to bind a sheet bundle with a staple.

BACKGROUND ART

In an image forming apparatus configured to use electrophotographic technology, image formation is generally formed by developing an electrostatic latent image that is formed on an image carrier such as a photosensitive member according to image information by developer, transferring a toner image obtained as a result of the developing to a sheet directly or via an intermediate transfer member, and causing the sheet to pass (a pressure contact portion) between a heating roll for fixing and a pressing roll or a belt so that the toner image is fixed on the sheet. In the meantime, a phenomenon that the sheet after fixing is curved and deformed so as to warp toward a front surface-side or a back surface-side of the sheet, i.e., a so-called curl may occur.

Therefore, in the image forming apparatus, it is available curl correction technology that enables a curled sheet to be substantially flat according to a form of a post-processing apparatus such as a stacker capable of stacking a large amount of sheets (for example, refer to PTL 1).

There is a post-processing apparatus having an electric stapler configured to bind a sheet bundle with a staple. In the meantime, there is also an electric stapler independent of the image forming apparatus (for example, refer to PTL 2). There is also an operation form where the electric stapler independent of the post-processing apparatus is mounted on the post-processing apparatus such as a stacker, and a sheet bundle arranged in the stacker is taken out and is bound by the electric stapler.

PTL 1: JP-A-2005-096892

PTL 2: Japanese Patent No. 4,277,417

In a case where the electric stapler is mounted on the post-processing apparatus, it is possible to perform the curl correction according to the electric stapler, in the image forming apparatus. In contrast, in a case where the electric stapler is independent of the post-processing apparatus, the sheet bundle for which the curl correction has been performed according to the stacker in the image forming apparatus may not be suitable for binding processing in the electric stapler.

In general, the curled sheet bundle is unlikely to be arranged neatly at end portions of the respective sheets. There is an electric stapler where control of starting binding processing is performed when end portions of a sheet bundle inserted between a pair of upper and lower guide parts are detected by a sensor. However, even when the end portions of the sheet bundle are not arranged neatly, a binding operation starts. Therefore, the sheet bundle may be bound with the staple in a state where the end portions of the sheet bundle are not arranged neatly. Like this, the situation where the sheet bundle is bound with the staple without the end portions of the sheet bundle being arranged neatly is referred to as 'bundle deviation'.

It is therefore an object of the present invention to provide an electric stapler capable of, even though a curled sheet bundle is inserted between guide parts, arranging neatly end portions of the sheet bundle by correcting curl of the sheet bundle.

SUMMARY

According to an aspect of the invention, there is provided the following electric stapler.

The electric stapler includes: a binding part configured to bind a sheet bundle by striking out a staple having a crown portion and leg portions; and a first guide part configured to guide the sheet bundle to the binding part, and a second guide part facing the first guide part, wherein the first guide part and the second guide part face each other at a distance equal to or greater than a thickness of a sheet bundle where a maximum number of bindable sheets capable of being bound by the staple are stacked, wherein the first guide part and the second guide part are opened therebetween as both sides along a length direction of the crown portion of the staple, which is struck out by the binding part, and one side away from the binding part along a direction orthogonal to the length direction of the crown portion are coupled each other, and wherein lengths from end portions on one side, which are away from the binding part along the direction orthogonal to the length direction of the crown portion, of the first guide part and the second guide part to the binding part are 15 mm or longer.

DESCRIPTION OF EMBODIMENTS

<Configuration Example of Electric Stapler of First Embodiment>

Figure 1A:
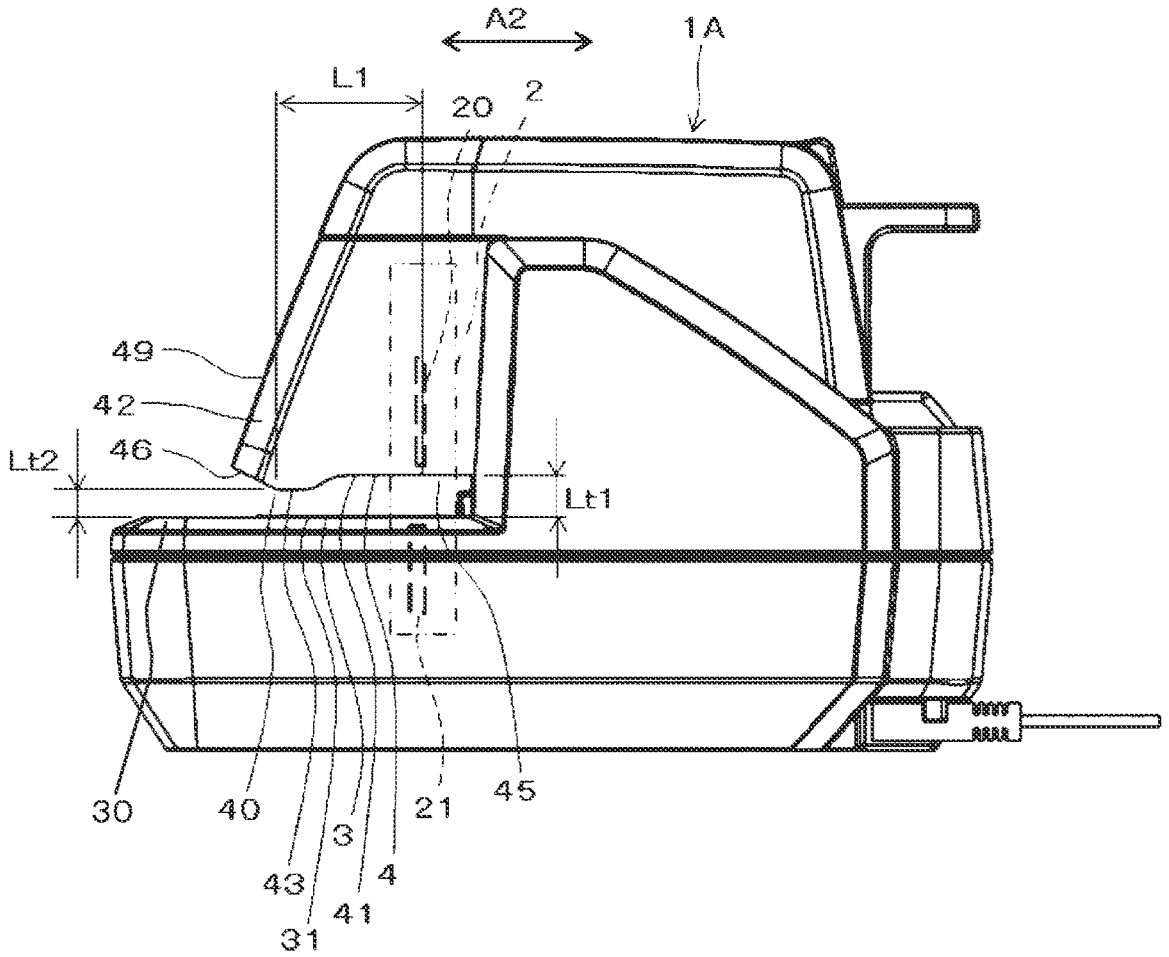
FIG. 1A is a side view depicting an example of an electric stapler of a first embodiment.
Figure 1B:
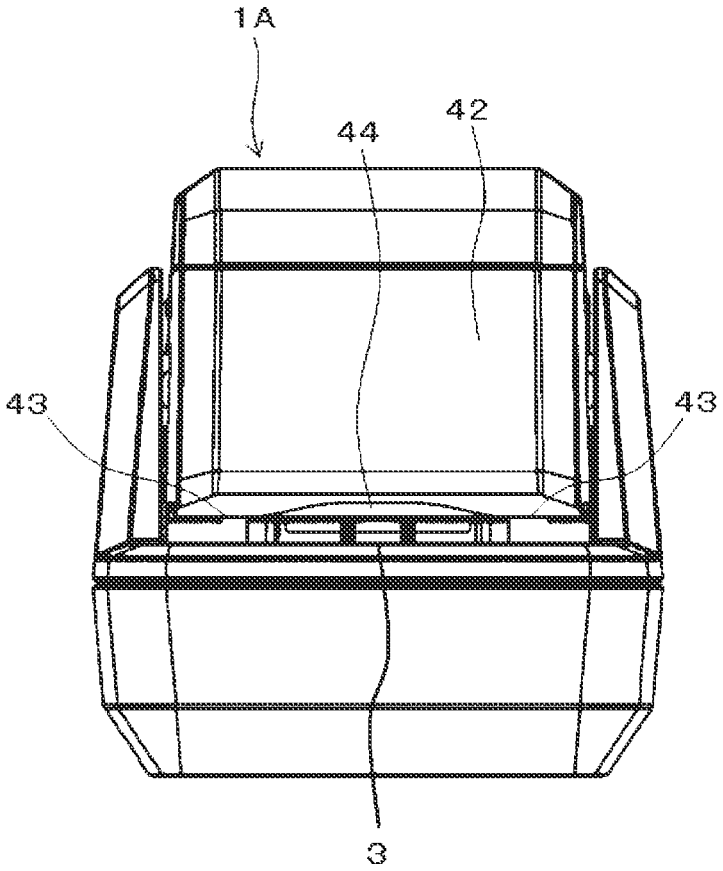
FIG. 1B is a front view depicting the example of the electric stapler of the first embodiment.
Figure 1C:
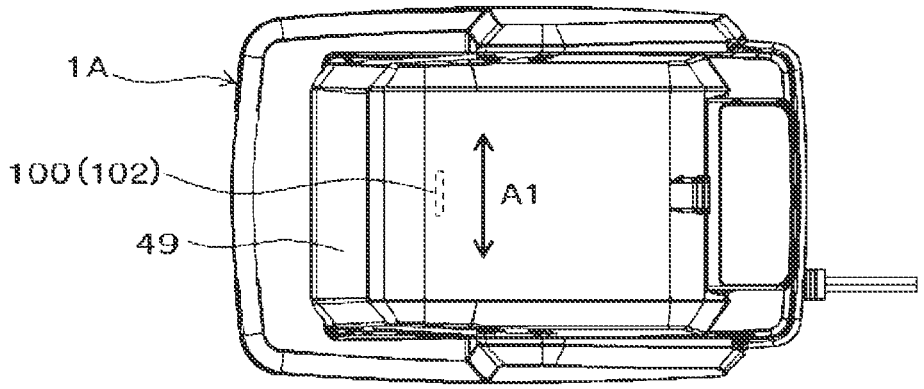
FIG. 1C is a top view depicting the example of the electric stapler of the first embodiment.
Figure 1D:
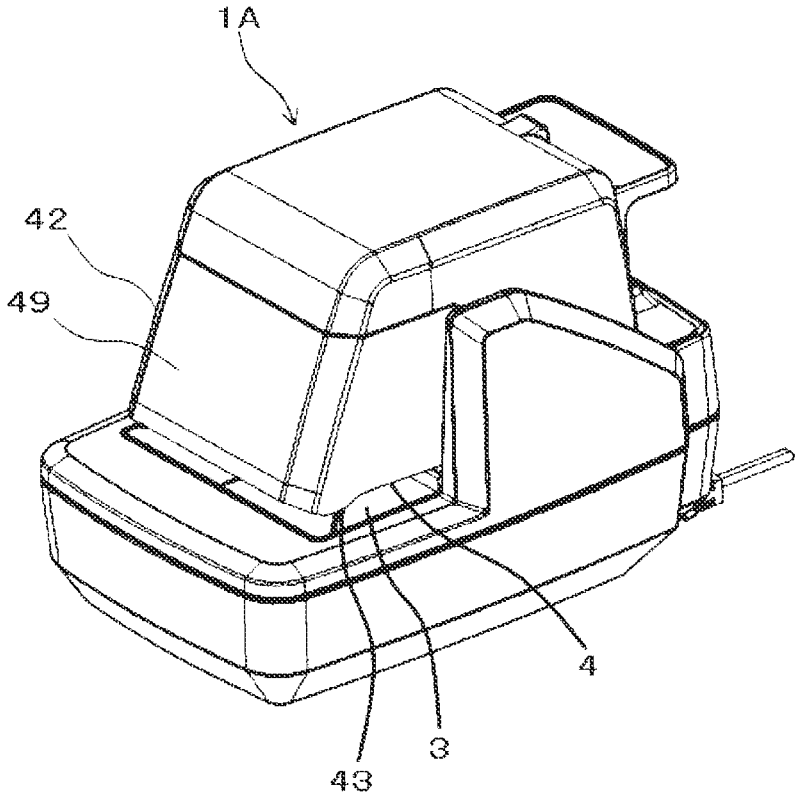
FIG. 1D is a perspective view depicting the example of the electric stapler of the first embodiment.

FIG. 1A is a side view depicting an example of an electric stapler of a first embodiment, FIG. 1B is a front view depicting the example of the electric stapler of the first embodiment, FIG. 1C is a top view depicting the example of the electric stapler of the first embodiment, and FIG. 1D is a perspective view depicting the example of the electric stapler of the first embodiment.

Figure 2A:
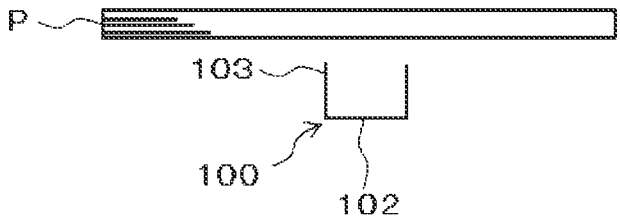
FIG. 2A illustrates an example of an operation of binding a sheet bundle with a staple.
Figure 2B:
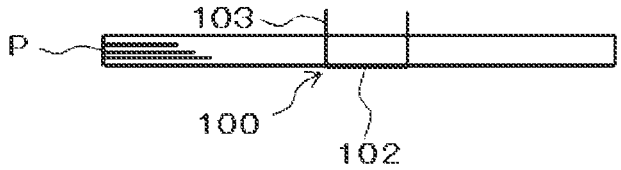
FIG. 2B illustrates the example of the operation of binding the sheet bundle with the staple.
Figure 2C:
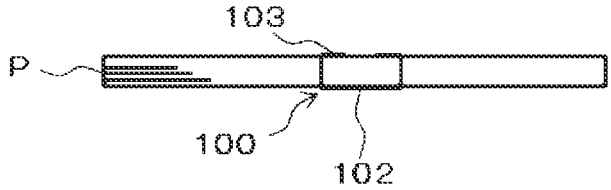
FIG. 2C illustrates the example of the operation of binding the sheet bundle with the staple.
Figure 3A:
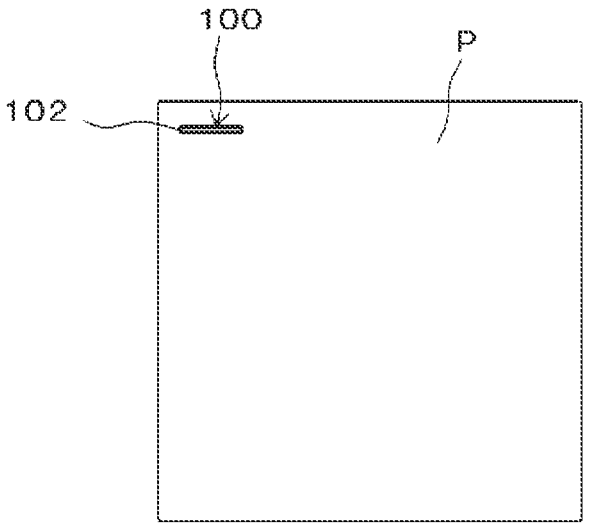
FIG. 3A is a plan view of the sheet bundle bound with the staple.
Figure 3B:
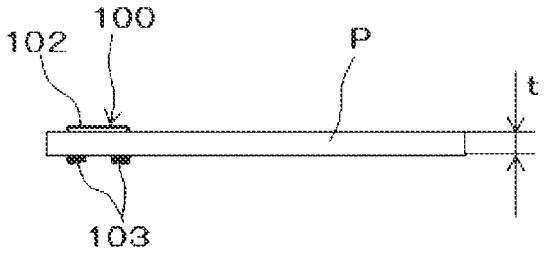
FIG. 3B is a front view of the sheet bundle bound with the staple.
Figure 3C:
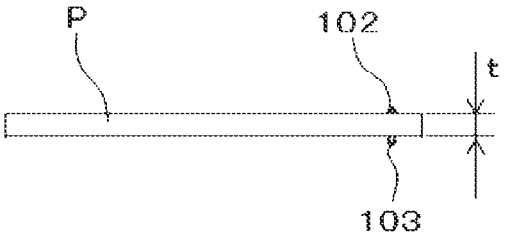
FIG. 3C is a side view of the sheet bundle bound with the staple.
Figure 5A:
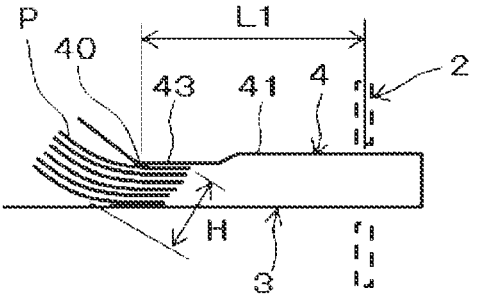
FIG. 5A illustrates an example of an operation of binding a sheet bundle by the electric stapler.

Also, FIGS. 2A to 2C illustrate an example of an operation of binding a sheet bundle with a staple, FIG. 3A is a plan view of the sheet bundle bound with the staple, FIG. 3B is a front view of the sheet bundle bound with the staple, and FIG. 3C is a side view of the sheet bundle bound with the staple. An operation of binding a sheet bundle P with a staple 100 is first described. One staple 100 is separated from a staple sheet where linear staples are coupled in a direction orthogonal to a length direction, and both ends of the liner staple 100 are bent in one direction, so that leg portions 103 are formed at both ends of a crown portion 102, as shown in FIG. 5A.

As shown in FIG. 2B, the leg portions 103 penetrate the sheet bundle P up to a position in which the crown portion 102 of the staple 100 is in contact with the sheet bundle P. As shown in FIG. 2C, the leg portions 103 of the staple 100 whose leg portions 103 penetrate the sheet bundle P are bent, and the sheet bundle P is bound with the staple 100, as shown in FIGS. 3A to 3C.

Subsequently, an electric stapler 1A of the first embodiment is described with reference to each drawing. As shown in FIGS. 1A to 1D, the electric stapler 1A includes a binding part 2 configured to strike out the staple 100 for binding the sheet bundle P, a first guide part 3 and a second guide part 4 facing the first guide part 3, which are a pair of guides configured to guide the sheet bundle P to the binding part 2.

A driver 20 configured to strike out the staple 100 is provided on the second guide part 4-side of the binding part 2, and a clincher 21 configured to bend the leg portions 103 of the staple 100, which penetrate the sheet bundle P, is provided on the first guide part 3-side with facing the driver 20. The electric stapler 1A includes a mechanism configured to drive the driver 20, a mechanism configured to drive the clincher 21, a mechanism configured to hold the sheet bundle P, and the like by a motor.

The first guide part 3 is a part that faces upward and is substantially flat, in a form where the electric stapler 1A is used with being placed, and becomes a placement surface on which the sheet bundle P is placed. The second guide part 4 is a part that faces downward, in a form where the electric stapler 1A is used with being placed, and becomes a top surface facing the first guide part 3.

The first guide part 3 and the second guide part 4 face each other at a predetermined distance Lt1 equal to or greater than a maximum thickness t of the sheet bundle P in the vicinity of the binding part 2, on a side along the length direction of the crown portion 102 of the staple 100 that is struck out by the binding part 2 and on a side along a direction orthogonal to the length direction of the crown portion 102. The maximum thickness t of the sheet bundle P is, for example, a thickness of the sheet bundle P where a maximum number of bindable sheets, which can be bound by the staple 100, are stacked. Also, the direction along the length direction of the crown portion 102 is denoted with an arrow A1, and the direction orthogonal to the length direction of the crown portion 102 is denoted with an arrow A2.

The distance Lt1 between the first guide part 3 and the second guide part 4 is preferably a value obtained by adding a length of about two times as large as a thickness of the staple 100 to the maximum thickness t of the sheet bundle P. This is because when the sheet bundle P is bound with the staple 100, the crown portion 102 is exposed on one surface of the sheet bundle P and the leg portions 103 are exposed on the other surface, as shown in FIGS. 3A to 3C.

The first guide part 3 and the second guide part 4 are opened therebetween as both sides along the length direction of the crown portion 102 denoted with the arrow A1 and one side away from the binding part 2 along the direction denoted with the arrow A2 orthogonal to the length direction of the crown portion 102 are coupled each other. In the present example, the first guide part 3 and the second guide part 4 are opened in three directions.

A length L1 of the second guide part 4 from an end portion 40 of the second guide part 4 on one side away from the binding part 2 along the direction denoted with the arrow A2 orthogonal to the length direction of the crown portion 102 to the binding part 2 is 15 mm or longer. Assuming a form where the sheet bundle P is placed, a length of the first guide part 3 along the direction denoted with the arrow A2 orthogonal to the length direction of the crown portion 102 is configured to be longer than the length of the second guide part 4 in the same direction. Thus, a length of the first guide part 3 from an end portion 30 of the first guide part 3 on one side away from the binding part 2 along the direction denoted with the arrow A2 orthogonal to the length direction of the crown portion 102 to the binding part 2 is also 15 mm or longer.

The first guide part 3 has a guide surface 31, which is in contact with the sheet bundle P, between the end portion 30 on one side away from the binding part 2 along the direction denoted with the arrow A2 orthogonal to the length direction of the crown portion 102 and the binding part 2.

Figure 4A:
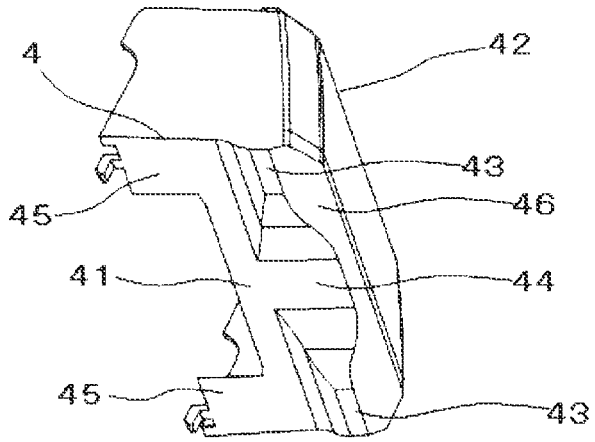
FIG. 4A is a perspective view depicting an example of a cover, as seen from below.
Figure 4B:
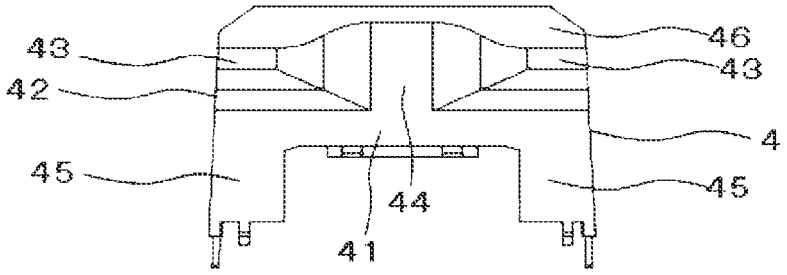
FIG. 4B is a bottom view depicting the example of the cover.
Figure 4C:
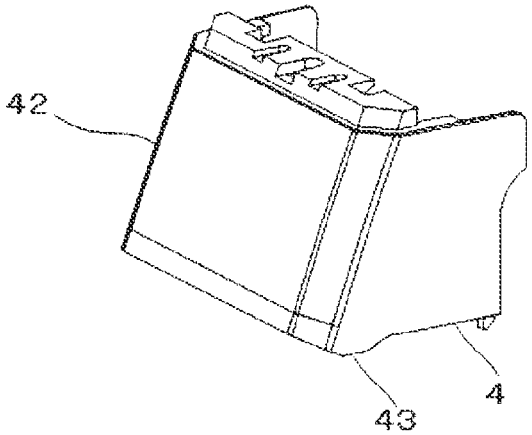
FIG. 4C is a perspective view depicting the example of the cover, as seen from above.

The electric stapler 1A has a cover 42 that configures the second guide part 4. FIG. 4A is a perspective view depicting an example of the cover, as seen from below, FIG. 4B is a bottom view depicting the example of the cover, and FIG. 4C is a perspective view depicting the example of the cover, as seen from above.

As shown in FIGS. 1A to 1D, the cover 42 is configured to cover the driver 20, a mechanism for driving the driver 20, and the like, and is attached facing the first guide part 3.

The second guide part 4 has a guide surface 41, which is in contact with the sheet bundle P, between the end portion 40 on one side away from the binding part 2 along the direction denoted with the arrow A2 orthogonal to the length direction of the crown portion 102 and the binding part 2. The guide surface 41 is configured by a part of the cover 42 facing the guide surface 31 of the first guide part 3, and is configured to cover an area from the end portion 40 of the second guide part 4 to a vicinity of the binding part 2.

The second guide part 4 has restraint portions 43 for restraining the number of sheets that are inserted between the first guide part 3 and the second guide part 4. The restraint portions 43 are configured by convex portions provided on both sides of the end portion 40 of the second guide part 4 in the length direction of the crown portion 102 denoted with the arrow A1 and protruding from the second guide part 4 toward the first guide part 3. The restraint portions 43 may be provided on the first guide part 3, not the second guide part 4, or the restraint portions 43 may be provided on the first guide part 3 and the second guide part 4, respectively.

The first guide part 3 and the second guide part 4 face each other at a predetermined distance Lt2, which is equivalent to the maximum thickness t of the sheet bundle P, at portions at which the restraint portions 43 are provided.

Also, the second guide part 4 has a first relief portion 44 that is provided between the pair of restraint portions 43 and enables the staple 100, which has bound the sheet bundle P, to pass therethrough. The first relief portion 44 is an example of the relief portion, and has a shape that is concave with respect to the restraint portion 43 and has a dimension equal to or greater than the thickness of the staple 100.

Also, the second guide part 4 has second relief portions 45 that are provided on both sides along the length direction of the crown portion 102 denoted with the arrow A1 and enable the staple 100, which has bound the sheet bundle P, to pass therethrough. The second relief portion 45 is an example of the relief portion, and has a shape that is concave with respect to the restraint portion 43 and has a dimension equal to or greater than the thickness of the staple 100. The second relief portion 45 may also be provided only on one side along the length direction of the crown portion 102, not on both sides.

Also, the second guide part 4 has a guiding portion 46 that is provided on a tip end-side of the end portion 40 and is inclined in a direction in which the distance between the first guide part 3 and the second guide part 4 increases.

The electric stapler 1A has an inclined surface 49 on a front face of the cover 42. The inclined surface 49 is configured by an inclined surface inclined in a direction in which a side close to the guiding portion 46 more protrudes forward than a side distant from the guiding portion 46. Note that, in the present embodiment, the end portion 40 means an end portion on an opening-side of the restraint portion 43.

<Operation Example of Electric Stapler of First Embodiment>

Figure 5B:
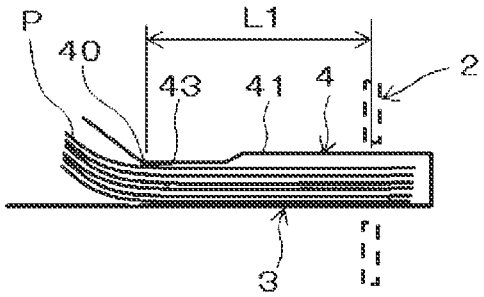
FIG. 5B illustrates the example of the operation of binding the sheet bundle by the electric stapler.

FIGS. 5A, 5B, 5C and 5E illustrate examples of an operation of binding a sheet bundle by the electric stapler. In the below, the operation of binding the sheet bundle P by the electric stapler 1A is described with reference to each drawing. In addition, FIG. 5D illustrates an example of an operation of binding a sheet bundle by a related-art electric stapler.

An operation of inserting the sheet bundle P, which is not bound yet with the staple 100, between the first guide part 3 and the second guide part 4 causes the sheet bundle P to enter between the first guide part 3 and the second guide part 4 by 15 mm or greater from the end portion 40 of the second guide part 4 toward the binding part 2.

As shown in FIG. 5A, in a case where the sheet bundle P before sheets having images formed thereon in an image forming apparatus are bound with the staple 100 is curled, when the sheet bundle P is introduced between the first guide part 3 and the second guide part 4, the curled part of the sheet bundle P is contacted to the second guide part 4. The sheet bundle P is first contacted to the restraint portions 43 and is then contacted to the guide surface 41.

When the electric stapler 1A is equipped at a place where a height from a floor surface is about 1 m, such as an upper surface of an image forming apparatus (not shown), a user inserts the sheet bundle P between the first guide part 3 and the second guide part 4 as if the sheet bundle is inserted obliquely from above. In this use form, while causing the sheet bundle P to collide with the front face of the cover 42, the sheet bundle P is inserted between the first guide part 3 and the second guide part 4 from the guiding portion 46. Therefore, the front face of the cover 42 is provided with the inclined surface 49 inclined in the direction in which the side close to the guiding portion 46 more protrudes forward than the side distant from the guiding portion 46, so that the sheet bundle P, which collides with the front face of the cover 42, can be guided to the guiding portion 46.

A curl amount H that is allowed in the image forming apparatus is about up to 10 mm to 15 mm in a thickness direction (curl height) of the sheet surface. When the curled sheet bundle P is inserted between the first guide part 3 and the second guide part 4, the sheet bundle P enters between the first guide part 3 and the second guide part 4 by 15 mm or longer from the end portion 40 of the guide part 4 along the first guide part 3 and the second guide part 4, as shown in FIG. 5B.

Figure 5C:
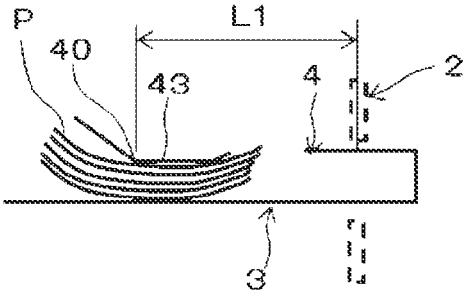
FIG. 5C illustrates the example of the operation of binding the sheet bundle by the electric stapler.
Figure 5D:
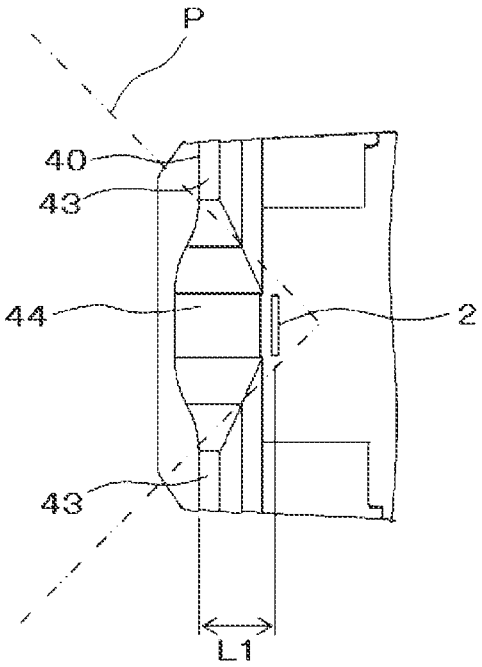
FIG. 5D illustrates an example of an operation of binding a sheet bundle by a related-art electric stapler.
Figure 5E:
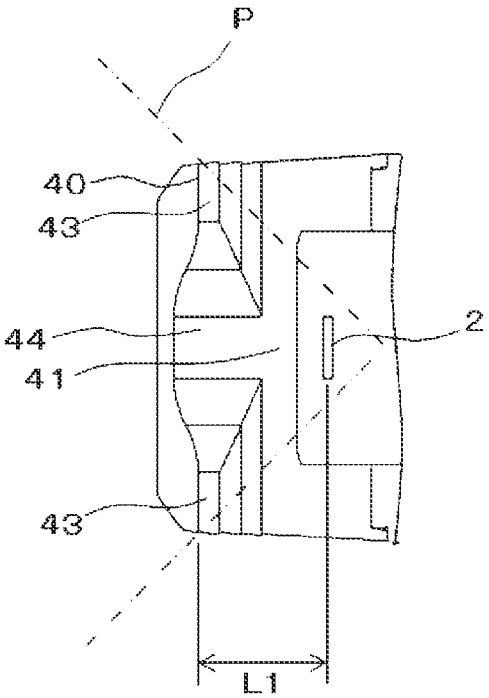
FIG. 5E illustrates the example of the operation of binding the sheet bundle by the electric stapler.

Here, for example, as shown in FIG. 5C, in a configuration where the guide surface 41 is not provided, the curled part of the sheet bundle P enters a space where there is no guide surface 41, so that the sheet bundle P may not be bound. In particular, as shown in FIG. 5E, when binding the sheet bundle P in a corner binding form, in the configuration where the guide surface 41 is not provided, a corner portion of the sheet bundle P is likely to enter the space where there is no guide surface 41, so that the corner portion of the sheet bundle P may be bound in a state where the corner portion of the sheet bundle P is folded.

In contrast, the guide surface 41 to which the sheet bundle P is contacted is provided from the end portion 40 of the second guide part 4 to the binding part 2, so that even when the sheet bundle P is curled, the sheet bundle P is advanced along the guide surface 41 with being in contact with the guide surface 41. For this reason, the curl of the sheet bundle P is corrected, irrespective of an insertion direction of the sheet bundle P, so that the end portions of the sheet bundle are arranged neatly.

Therefore, even in a case where control of starting binding processing by detecting the end portions of the sheet bundle P inserted between the first guide part 3 and the second guide part 4 by a sensor (not shown) (for example, by detecting that the end portions of the sheet bundle P have reached a binding position) is performed, the curl of the sheet bundle P is corrected, so that it is possible to bind the sheet bundle P with the staple 100 in a state where the end portions of the sheet bundle P are arranged neatly. Therefore, it is possible to suppress the sheet bundle P bound with the staple 100 form being put into a state of bundle deviation. Namely, the guide surface 41 is not essential in the present embodiment, however, a configuration where the guide surface 41 is provided is preferable.

Also, the first guide part 3 and the second guide part 4 face each other at the predetermined distance Lt2, which is equivalent to the maximum thickness t of the sheet bundle P, at portions at which the restraint portions 43 are provided.

Thereby, the sheet bundle P whose number of sheets exceeds the maximum number of bindable sheets is suppressed from being inserted between the first guide part 3 and the second guide part 4 beyond the restraint portions 43, so that it is possible to suppress poor binding due to the staple 100.

Also, in a case where the length L1 between the end portion 40 of the second guide part 4 and the binding part 2 is short (for example, smaller than 15 mm), when binding the sheet bundle P in a corner binding form, as shown in FIG. 5D, even though the restraint portions 43 are provided, the corner portion of the sheet bundle P may reach a detection position (for example, a binding position) of the sensor (not shown) before the sheet bundle P reaches the restraint portions 43, so that the binding processing may be executed. In this case, since the sheet bundle P is not restrained by the restraint portions 43, the operation of binding the sheet bundle P whose number of sheets exceeds the maximum number of bindable sheets is executed, so that poor binding may occur.

In contrast, the length L1 between the end portion 40 of the second guide part 4 and the binding part 2 is set to 15 mm or longer, and the end portion 40 of the second guide part 4 is provided with the restraint portions 43 on both sides along the length direction of the crown portion 102 denoted with the arrow A1, so that even when binding the sheet bundle P in a corner binding form, as shown in FIG. 5E, the sheet bundle P is restrained by the restraint portions 43. For this reason, in a case where the number of sheets exceeds the maximum number of bindable sheets, the sheet bundle P is contacted to the restraint portions 43 before the corner portion of the sheet bundle P reaches the detection position of the sensor (not shown), so that the insertion of the sheet bundle P is suppressed. Thereby, irrespective of the direction of the sheet bundle P that is inserted between the first guide part 3 and the second guide part 4, it is possible to suppress the operation of binding the sheet bundle P whose number of sheets exceeds the maximum number of bindable sheets. Note that, the length L1 between the end portion 40 of the second guide part 4 and the binding part 2 is set to 15 mm or longer, so that when foreign matters other than the sheet bundle P are inserted between the first guide part 3 and the second guide part 4 from the end portion 40, it is possible to suppress the foreign matters from reaching the binding part 2.

Also, the guiding portion 46 whose distance between the first guide part 3 and the second guide part 4 increases toward the end portion of the opening between the first guide part 3 and the second guide part 4 is provided on the tip end-side of the end portion 40 of the second guide part 4, so that even the curled sheet bundle P can be easily inserted between the first guide part 3 and the second guide part 4.

Figure 6A:
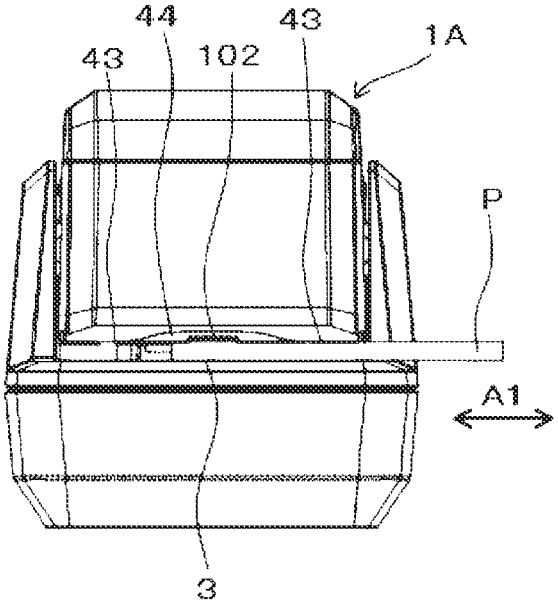
FIG. 6A is a front view of the electric stapler depicting a state after a sheet bundle of a maximum thickness is bound.
Figure 6B:
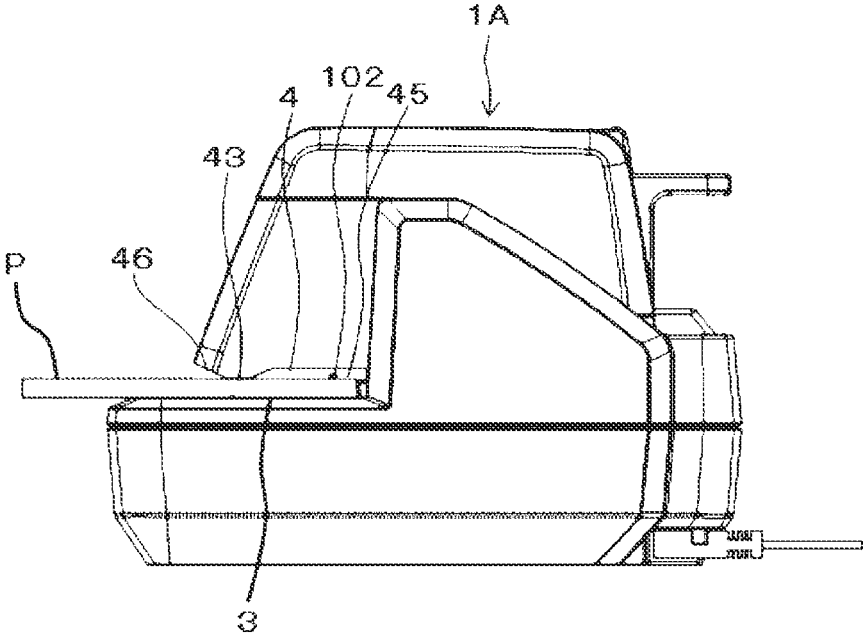
FIG. 6B is a side view of the electric stapler depicting the state after the sheet bundle of the maximum thickness is bound.

FIG. 6A is a front view of the electric stapler depicting a state after a sheet bundle of a maximum thickness is bound, and FIG. 6B is a side view of the electric stapler depicting the state after the sheet bundle of the maximum thickness is bound.

When the sheet bundle P is bound with the staple 100, the crown portion 102 is exposed on a surface of the sheet bundle P facing the second guide part 4 and the leg portions 103 are exposed on a surface of the sheet bundle P facing the first guide part 3.

In the vicinity of the binding part 2, the first guide part 3 and the second guide part 4 face each other at the predetermined distance Lt1 equal to or greater than the maximum thickness t of the sheet bundle P. Thereby, it is possible to bind the sheet bundle P of the maximum thickness t inserted between the first guide part 3 and the second guide part 4 with the staple 100.

However, in a case of pulling out the sheet bundle P bound with the staple 100 from between the first guide part 3 and the second guide part 4, when the restraint portions 43 are present in a path through which the staple 100 passes, the staple 100 may collide with the restraint portions 43, so that the sheet bundle P may not be pulled out.

Therefore, the second guide part 4 has the first relief portion 44 between the pair of restraint portions 43. The first relief portion 44 is provided in a position along the direction denoted with the arrow A2 orthogonal to the length direction of the crown portion 102 with respect to the binding part 2.

Thereby, when moving the sheet bundle P in a front and rear direction denoted with the arrow A2 orthogonal to the length direction of the crown portion 102, the restraint portions 43 are not present in the path through which the staple 100 passes, so that the crown portion 102 can pass through the first relief portion 44. Therefore, even when the sheet bundle P of the maximum thickness t is bound with the staple 100, it is possible to pull out the sheet bundle P from between the first guide part 3 and the second guide part 4 by moving the sheet bundle P in the front and rear direction.

Also, the second guide part 4 has the second relief portions 45 on both sides along the length direction of the crown portion 102 denoted with the arrow A1. The second relief portions 45 are provided along the length direction of the crown portion 102 denoted with the arrow A1 with respect to the binding part 2.

Thereby, when moving the sheet bundle P in a right and left direction along the length direction of the crown portion 102 denoted with the arrow A1, the restraint portions 43 are not present in the path through which the staple 100 passes.

Figure 7A:
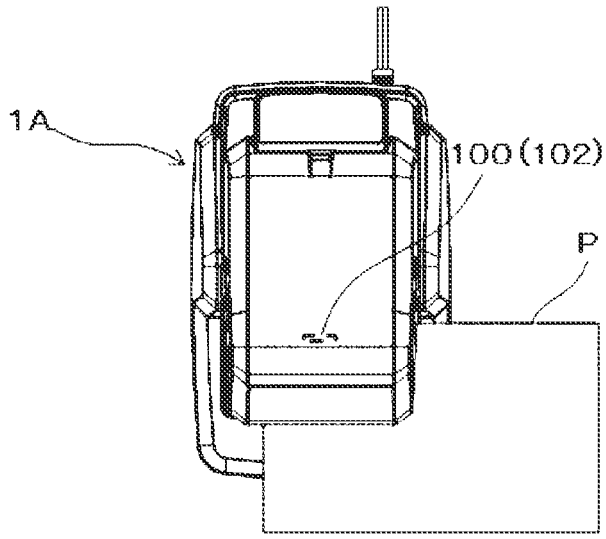
FIG. 7A is a plan view of the electric stapler depicting an example of an operation of binding a plurality of places of a sheet bundle with staples.
Figure 7B:
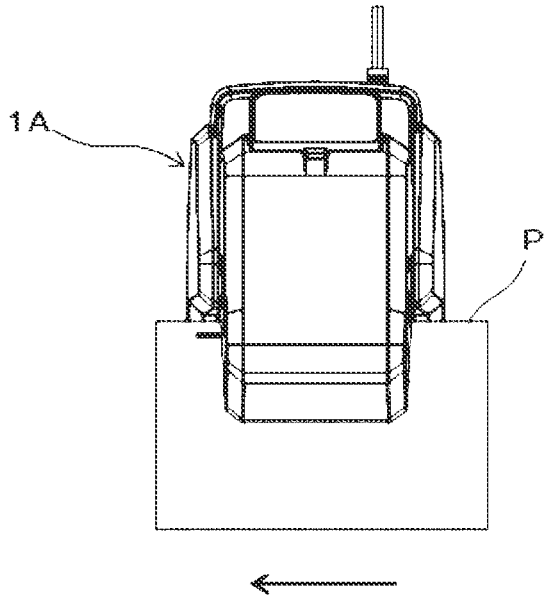
FIG. 7B is a plan view of the electric stapler depicting the example of the operation of binding the plurality of places of the sheet bundle with the staples.
Figure 7C:
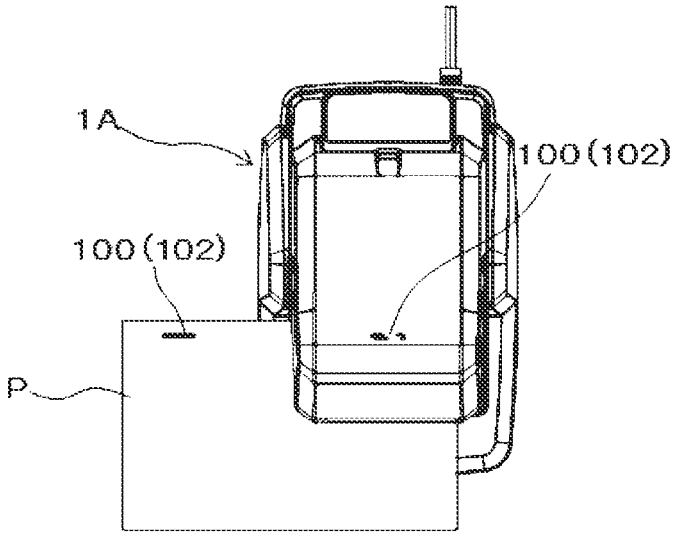
FIG. 7C is a plan view of the electric stapler depicting the example of the operation of binding the plurality of places of the sheet bundle with the staples.

FIGS. 7A to 7C are plan views of the electric stapler depicting an example of an operation of binding a plurality of places of a sheet bundle with staples.

First, as shown in FIG. 7A, a first place of the sheet bundle P is bound with the staple 100. Then, as shown in FIG. 7B, the sheet bundle P is moved in the right and left direction along the length direction of the crown portion 102 denoted with the arrow A1. As described above, the second relief portions 45 are provided, so that the crown portion 102 can pass through the second relief portions 45 by moving the sheet bundle P in the right and left direction.

Therefore, even when the sheet bundle P of the maximum thickness t is bound with the staple 100, it is possible to discharge the staple 100 that binds the first place of the sheet bundle P from a position facing the binding part 2 and to move the sheet bundle P to a position in which a second place of the sheet bundle P can be bound with the staple 100 by moving the sheet bundle P in the right and left direction, as shown in FIG. 7C.

A verification result of a relation between the length L1 from the end portion 40 of the second guide part 4 to the binding part 2 and the curl amount H of the sheet bundle P is shown in Table 1. In descriptions below, the length L1 from the end portion 40 of the second guide part 4 to the binding part 2 is referred to as the length L1 of the second guide part 4.

TABLE 1

| | | Curl amount H (mm) | | | |
|---|---|---|---|---|---|
| | | 5 | 10 | 15 | 20 |
| L1 (mm) | 0 | Δ | X | X | X |
| | 5 | Δ | X | X | X |
| | 10 | ○ | ○ | Δ | X |
| | 15 | ○ | ○ | ○ | Δ |
| | 20 | ○ | ○ | ○ | ○ |
| | 25 | ○ | ○ | ○ | ○ |
| | 30 | ○ | ○ | ○ | ○ |

Verification result:
○: no bundle deviation
Δ: slight bundle deviation
X: large bundle deviation In the case of the sheet bundle P where sheets having images formed thereon in the image forming apparatus are stacked, the curl amount H may reach up to about 10 mm to 15 mm. In a case where the length L1 of the second guide part 4 was 10 mm, slight bundle deviation was observed when the curl amount H was 15 mm. In a case where the length L1 of the second guide part 4 was smaller than 10 mm, large bundle deviation was observed even when the curl amount H was 10 mm.

In contrast, in a case where the length L1 of the second guide part 4 was equal to or larger than 15 mm, no bundle deviation was observed when the curl amount H was 15 mm. On the other hand, in a case where the curl amount H was 20 mm, which exceeds the assumption, slight bundle deviation was observed when the length L1 of the second guide part 4 was 15 mm. However, when the curl amount H was within the range of assumption, the bundle deviation could be suppressed.

Thereby, it could be seen that when the length L1 of the second guide part 4 is equal to or larger than 15 mm, it is possible to secure the effect of suppressing the bundle deviation of the sheet bundle P.

<Configuration Example of Electric Stapler of Second Embodiment>

Figure 8A:
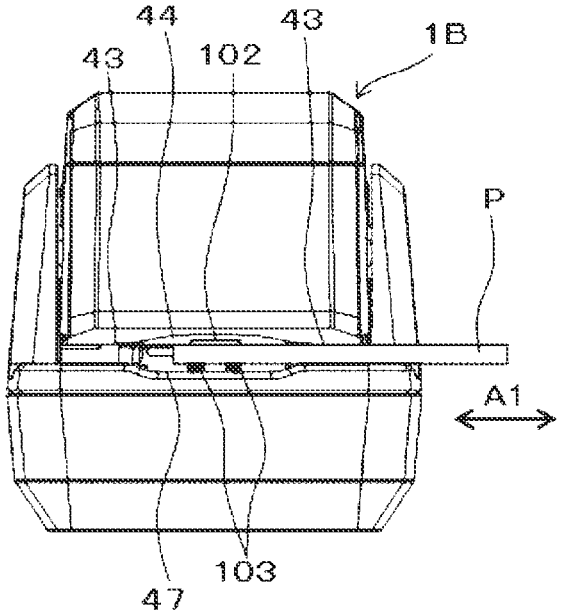
FIG. 8A is a front view depicting an example of an electric stapler of a second embodiment.
Figure 8B:
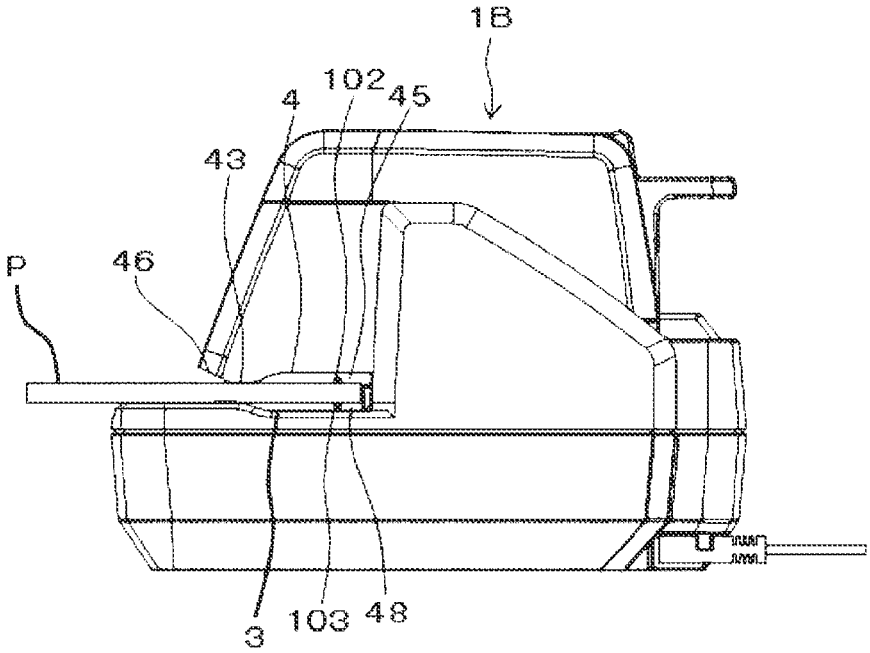
FIG. 8B is a side view depicting the example of the electric stapler of the second embodiment.

FIG. 8A is a front view depicting an example of an electric stapler of a second embodiment, and FIG. 8B is a side view depicting the example of the electric stapler of the second embodiment. In an electric stapler 1B of the second embodiment, the relief portion is provided for both the second guide part 4 and the first guide part 3. In the electric stapler 1B of the second embodiment, the configurations equivalent to the electric stapler 1A of the first embodiment are denoted with the same reference signs, and the descriptions thereof are omitted.

The electric stapler 1B has a third relief portion 47 at the first guide part 3. The third relief portion 47 is an example of the relief portion, and is provided facing the first relief portion 44 in a position along the direction denoted with the arrow A2 orthogonal to the length direction of the crown portion 102 with respect to the binding part 2.

Also, the electric stapler 1B has fourth relief portions 48 at the first guide part 3. The fourth relief portions 48 are an example of the relief portion, and are provided facing the second relief portions 45 in positions on both sides along the length direction of the crown portion 102 denoted with the arrow A1 with respect to the binding part 2.

Also in the configuration where the first guide part 3 is provided with the third relief portion 47 and the fourth relief portions 48, when moving the sheet bundle P in the front and rear direction denoted with the arrow A2 orthogonal to the length direction of the crown portion 102, the leg portions 103 can pass through the third relief portion 47. Therefore, even when the sheet bundle P of the maximum thickness t is bound with the staple 100, it is possible to pull out the sheet bundle P from between the first guide part 3 and the second guide part 4 by moving the sheet bundle P in the front and rear direction.

Also, when moving the sheet bundle P in the right and left direction along the length direction of the crown portion 102 denoted with the arrow A1, the leg portions 103 can pass through the fourth relief portions 48. Therefore, even when the sheet bundle P of the maximum thickness t is bound with the staple 100, it is possible to bind the plurality of places of the sheet bundle P with the staples 100 by moving the sheet bundle P in the right and left direction.

<Configuration Example of Electric Stapler of Third Embodiment>

Figure 9A:
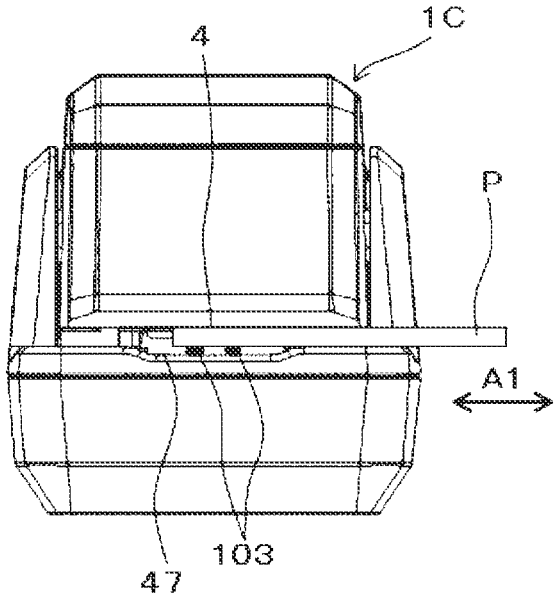
FIG. 9A is a front view depicting an example of an electric stapler of a third embodiment.
Figure 9B:
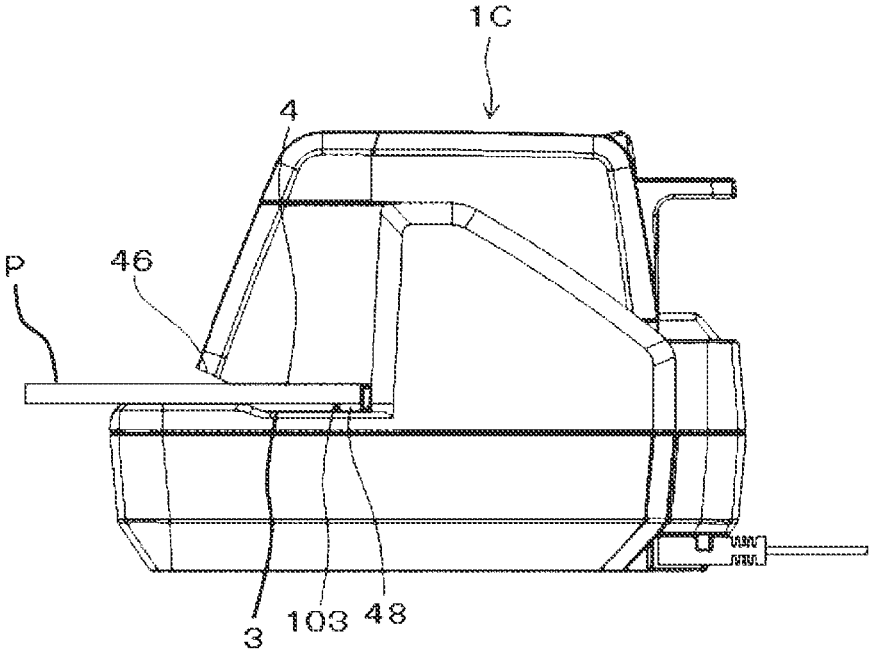
FIG. 9B is a side view depicting the example of the electric stapler of the third embodiment.

FIG. 9A is a front view depicting an example of an electric stapler of a third embodiment, and FIG. 9B is a side view depicting the example of the electric stapler of the third embodiment. In an electric stapler 1C of the third embodiment, the relief portion is not provided for the second guide part 4 and is provided for the first guide part 3. In the electric stapler 1C of the second embodiment, the configurations equivalent to the electric stapler 1A of the first embodiment are denoted with the same reference signs, and the descriptions thereof are omitted.

The electric stapler 1C has the third relief portion 47 at the first guide part 3. The third relief portion 47 is provided in a position along the direction denoted with the arrow A2 orthogonal to the length direction of the crown portion 102 with respect to the binding part 2.

Also, the electric stapler 1B has the fourth relief portions 48 at the first guide part 3. The fourth relief portions 48 are provided in positions on both sides along the length direction of the crown portion 102 denoted with the arrow A1 with respect to the binding part 2.

The first guide part 3 is provided with the third relief portion 47 and the fourth relief portions 48, so that when moving the sheet bundle P in the front and rear direction denoted with the arrow A2 orthogonal to the length direction of the crown portion 102, the leg portions 103 can pass through the third relief portion 47 even though the second guide part 4 is not provided with the relief portion. Therefore, even when the sheet bundle P of the maximum thickness t is bound with the staple 100, it is possible to pull out the sheet bundle P from between the first guide part 3 and the second guide part 4 by moving the sheet bundle P in the front and rear direction.

Also, when moving the sheet bundle P in the right and left direction along the length direction of the crown portion 102 denoted with the arrow A1, the leg portions 103 can pass through the fourth relief portions 48. Therefore, even when the sheet bundle P of the maximum thickness t is bound with the staple 100, it is possible to bind the plurality of places of the sheet bundle P with the staples 100 by moving the sheet bundle P in the right and left direction.

<Configuration Example of Electric Stapler of Fourth Embodiment>

Figure 10A:
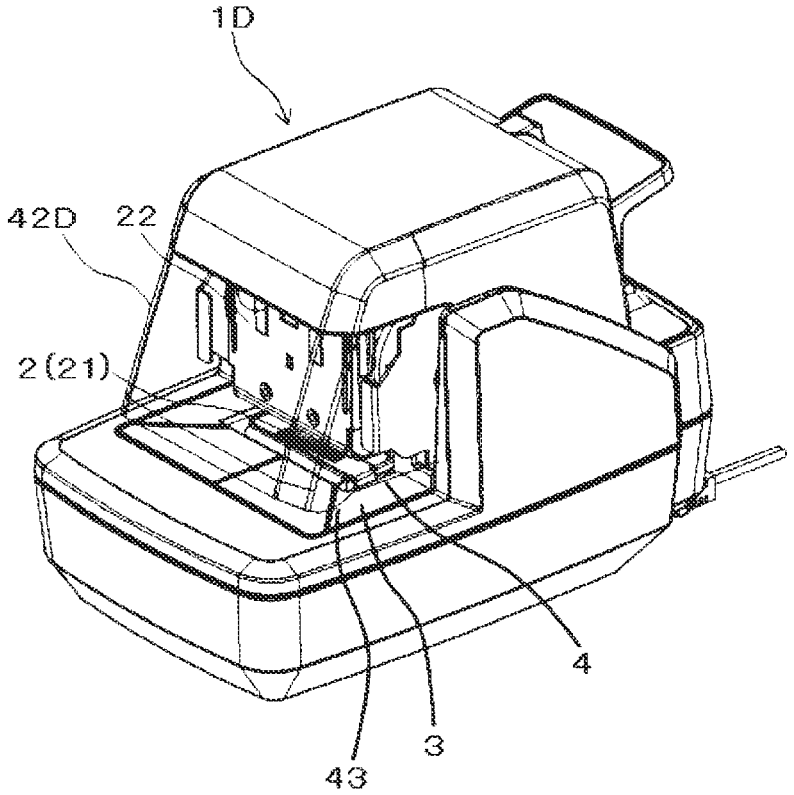
FIG. 10A is a perspective view depicting an example of an electric stapler of a fourth embodiment.
Figure 10B:
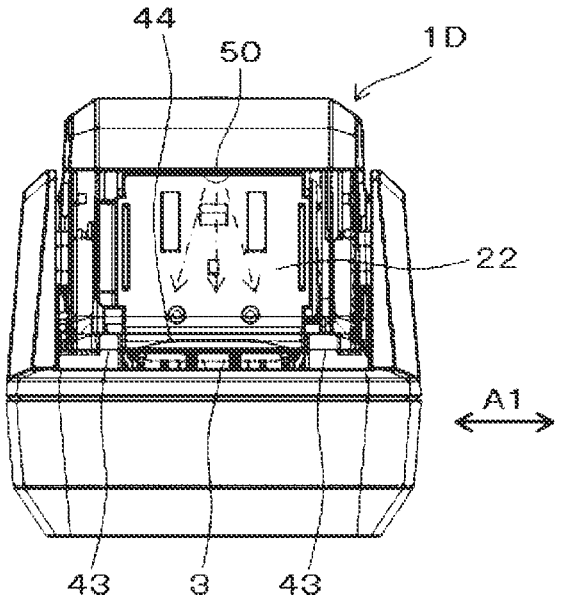
FIG. 10B is a front view depicting the example of the electric stapler of the fourth embodiment.
Figure 10C:
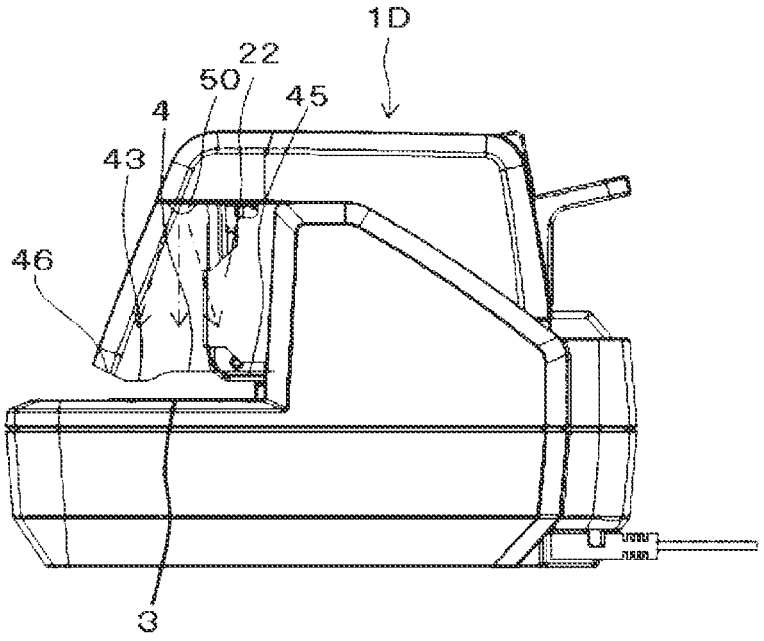
FIG. 10C is a side view depicting the example of the electric stapler of the fourth embodiment.

FIG. 10A is a perspective view depicting an example of an electric stapler of a fourth embodiment, FIG. 10B is a front view depicting the example of the electric stapler of the fourth embodiment, and FIG. 10C is a side view depicting the example of the electric stapler of the fourth embodiment. In an electric stapler 1D of the fourth embodiment, the configurations equivalent to the electric stapler 1A of the first embodiment are denoted with the same reference signs, and the descriptions thereof are omitted.

In the electric stapler 1D, a cover 42D that configures the second guide part 4 is formed of a clear resin material capable of enabling light to transmit therethrough so that an inside of the cover 42D can be seen. A front face, both side surfaces and a surface facing the first guide part 3 of the cover 42D are clear, so that it is possible to visually recognize the vicinity of the binding position by the binding part 2.

Also, the electric stapler 1D has a light source 50 inside of the cover 42D. The light source 50 is configured by, for example, an LED, and is configured to irradiate the first guide part 3 from above a driver mechanism unit 22, as shown with arrows of dashed-dotted arrow lines in FIGS. 10B and 10C. Thereby, the vicinity of the binding position by the binding part 2 is irradiated and can be easily visually recognized. Also, it is possible to notify states of the electric stapler 1D by combinations of lighting and lights-out, blinking, color and the like of the light source 50.

<Configuration Example of Electric Stapler of Fifth Embodiment>

Figure 11A:
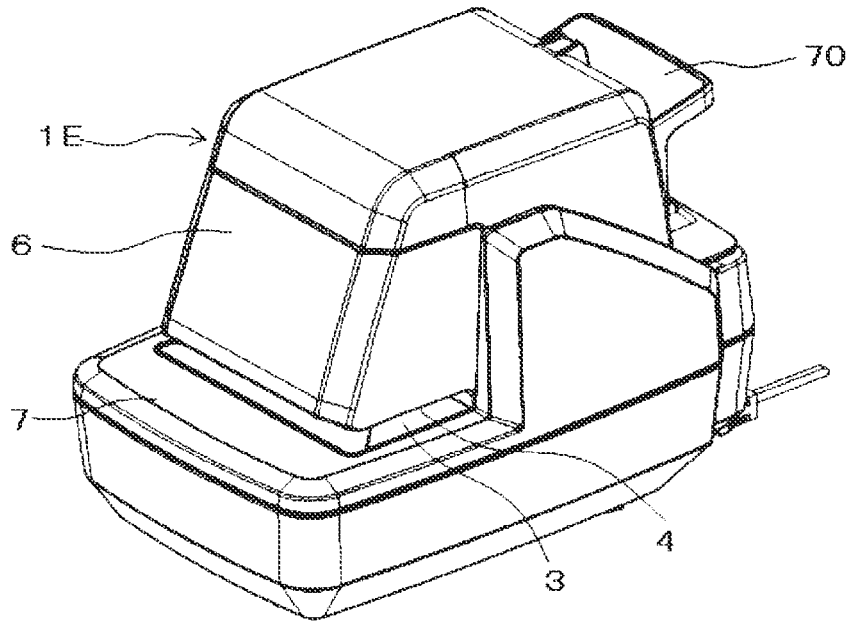
FIG. 11A is a perspective view depicting an example of an electric stapler of a fifth embodiment.
Figure 11B:
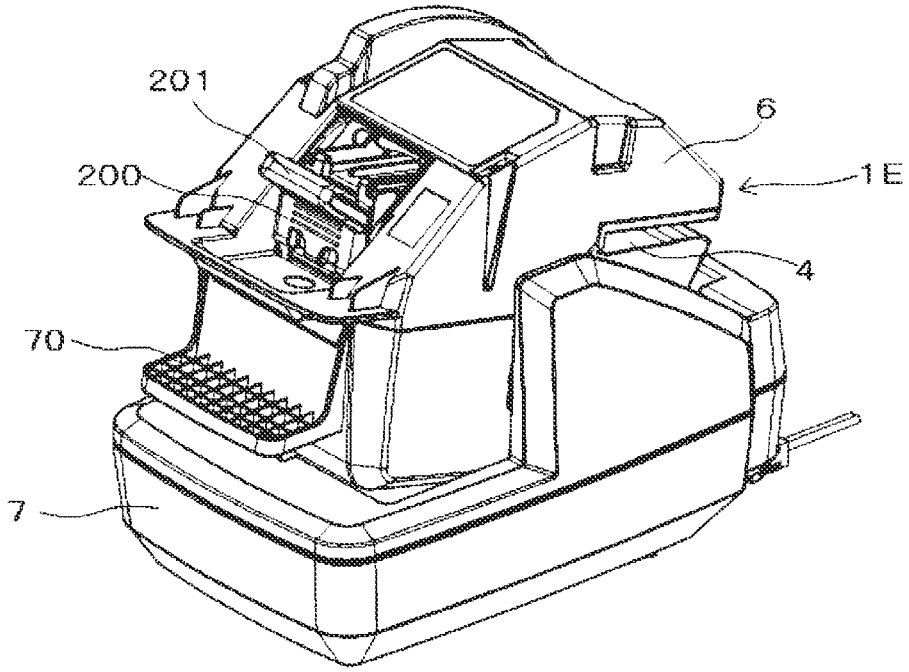
FIG. 11B is a perspective view depicting the example of the electric stapler of the fifth embodiment.
Figure 11C:
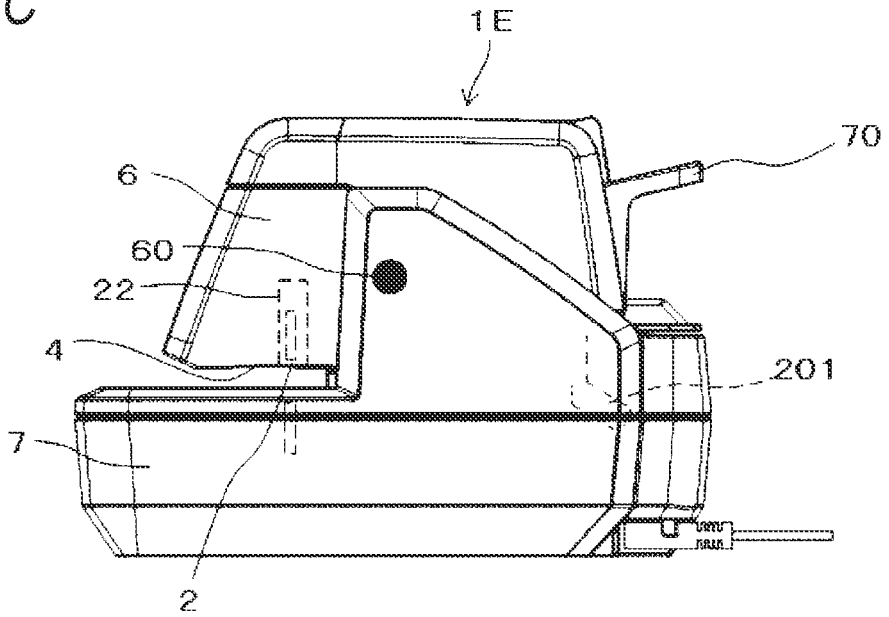
FIG. 11C is a side view depicting the example of the electric stapler of the fifth embodiment.
Figure 11D:
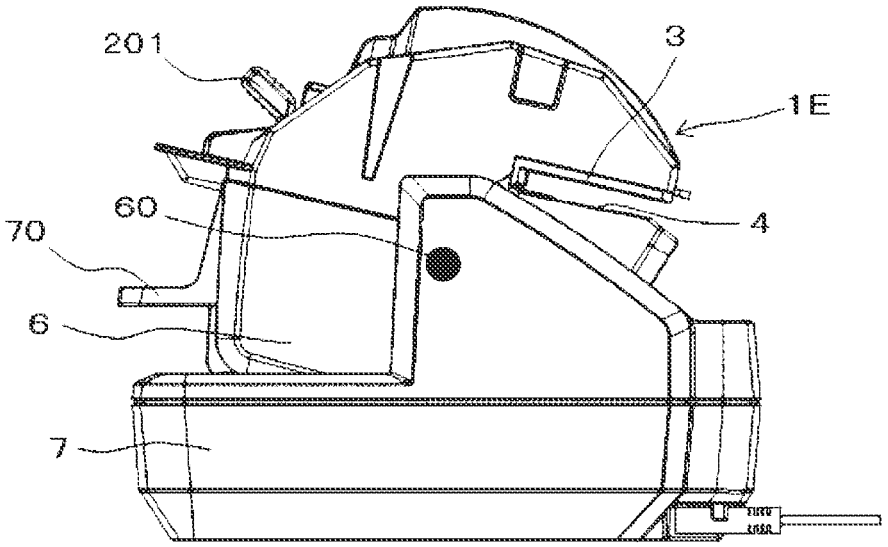
FIG. 11D is a side view depicting the example of the electric stapler of the fifth embodiment.

FIGS. 11A and 11B are perspective views depicting an example of an electric stapler of a fifth embodiment, and FIGS. 11C and 11D are side views depicting the example of the electric stapler of the fifth embodiment. In an electric stapler 1E of the fifth embodiment, the configurations equivalent to the electric stapler 1A of the first embodiment are denoted with the same reference signs, and the descriptions thereof are omitted.

The electric stapler 1E includes a base unit 6 that is equipped in an equipment place, and a mechanism unit 7 having the driver mechanism unit 22 and the like configuring the binding part 2. In the electric stapler 1E, the mechanism unit 7 enabling a cartridge 200 having the staples 100 accommodated therein to be detachably mounted to the base unit 6 is configured to be reversed by a rotation operation about a shaft 60 as a support point, so as to detachably mount the cartridge 200.

The electric stapler 1E has an operation handle 70 to which an operation of rotating the mechanism unit 7 is applied. In the electric stapler 1E, a state where the mechanism unit 7 is located in an operable position is shown in FIGS. 11A and 11C. In a state where the mechanism unit 7 is located in an operable position, the operation handle 70 is provided at a rear end portion on a side of the mechanism unit 7, which is opposite to a side on which the first guide part 3 and the fourth guide part 4 are provided. The operation handle 70 protrudes rearward from the rear end-side of the mechanism unit 7 and is inclined upward from the mechanism unit 7-side.

In the electric stapler 1E, in the state where the mechanism unit 7 is located in the operable position, an attachment/detachment handle 201 of the cartridge 200 is accommodated in the base unit 6. Thereby, an outer appearance of the electric stapler 1E is improved, and unintentional attachment/detachment of the cartridge 200 can be suppressed. Also, the operation handle 70 protrudes rearward from the rear end-side of the mechanism unit 7 with being inclined upward from the mechanism unit 7-side, so that the operation handle 70 can be easily visually recognized and operated with a hand.

In the electric stapler 1E, a state where the mechanism unit 7 is located in an attachable/detachable position of the cartridge 200 is shown in FIGS. 11B and 11D. When a force of rotating the mechanism unit 7 about the shaft 60 as a support point while gripping the operation handle 70 with a hand is transmitted to the mechanism unit 7 via the operation handle 70, the mechanism unit 7 is turned upside down from the operable position by the rotation operation about the shaft 60, and is moved to the attachable/detachable position of the cartridge 200.

In the electric stapler 1E, in the state where the mechanism unit 7 is located in the attachable/detachable position of the cartridge 200, the cartridge 200 and the attachment/detachment handle 201 are exposed to the outside from the base unit 6 and the mechanism unit 7. Thereby, it is possible to attach/detach the cartridge 200 while gripping the attachment/detachment handle 201.

According to an aspect of the invention, the length from one end portions on one side, which is away from the binding part along the direction orthogonal to the length direction of the crown portion, of the first guide part and the second guide part to the binding part is set to 15 mm or longer. Therefore, even when the sheet bundle is curled, while the sheet bundle is inserted from the end portions between the first guide part and the second guide part to the binding part, the curl is corrected by the first guide part and the second guide part. For this reason, it is possible to arrange neatly the end portions of the sheets while binding the sheet bundle, so that it is possible to suppress the sheet bundle bound with the staple from being put into a state of bundle deviation.

What is claimed is:

1. An electric stapler comprising:

a binding part configured to bind a sheet bundle by striking out a staple having a crown portion and leg portions; and a first guide part configured to guide the sheet bundle to the binding part, and a second guide part facing the first guide part, wherein the first guide part and the second guide part face each other at a distance equal to or greater than a thickness of a sheet bundle where a maximum number of bindable sheets capable of being bound by the staple are stacked, wherein the first guide part and the second guide part are opened therebetween as both sides along a length direction of the crown portion of the staple, which is struck out by the binding part, and one side away from the binding part along a direction orthogonal to the length direction of the crown portion are coupled to each other, wherein lengths from end portions on one side, which are away from the binding part along the direction orthogonal to the length direction of the crown portion, of the first guide part and the second guide part to the binding part are 15 mm or longer, wherein at least one of the first guide part and the second guide part has a restraint portion for restraining a number of sheets that are inserted between the first guide part and the second guide part, and wherein at least one of the first guide part and the second guide part has a first relief portion having a shape that is concave with respect to the restraint portion and has a dimension equal to or greater than a thickness of the staple, and enabling the staple that has bound the sheet bundle to pass therethrough.

2. The electric stapler according to claim 1, wherein the second guide part has a guide surface between the end portion on one side away from the binding part along the direction orthogonal to the length direction of the crown portion and the binding part.

3. The electric stapler according to claim 1, wherein at least one of the first guide part and the second guide part has a second relief portion provided on both sides or one side along the length direction of the crown portion and enabling the staple that has bound the sheet bundle to pass therethrough.

4. The electric stapler according to claim 1, wherein at least one of the first guide part and the second guide part has a guiding portion that is provided on a tip end-side of the end portion on one side away from the binding part along the direction orthogonal to the length direction of the crown portion and is inclined in a direction in which the distance between the first guide part and the second guide part increases.

5. The electric stapler according to claim 1, further comprising a cover that configures the second guide part, wherein the cover is formed of a clear material enabling an inside of the cover to be seen.

6. The electric stapler according to claim 5, further comprising a light source inside of the cover, wherein the light source is configured to irradiate the inside of the cover with light.

7. An electric stapler comprising:

a binding part configured to bind a sheet bundle by striking out a staple having a crown portion and leg portions; and a first guide part configured to guide the sheet bundle to the binding part, and a second guide part facing the first guide part, wherein the first guide part and the second guide part face each other at a distance equal to or greater than a thickness of a sheet bundle where a maximum number of bindable sheets capable of being bound by the staple are stacked, wherein the first guide part and the second guide part are opened therebetween as both sides along a length direction of the crown portion of the staple, which is struck out by the binding part, and one side away from the binding part along a direction orthogonal to the length direction of the crown portion are coupled to each other, wherein lengths from end portions on one side, which are away from the binding part along the direction orthogonal to the length direction of the crown portion, of the first guide part and the second guide part to the binding part are 15 mm or longer, a cover that configures the second guide part, wherein the cover is formed of a clear material enabling an inside of the cover to be seen, and a front face of the cover is provided with an inclined surface whose side close to the second guide part protrudes more forward than a side distant from the second guide part.

* * * * *